US006481182B1

(12) United States Patent
Fuller

(10) Patent No.: US 6,481,182 B1
(45) Date of Patent: Nov. 19, 2002

(54) PLASTIC GLOVES ASSEMBLAGE FOR POINT-OF-SALES DISPLAY AND STORAGE

(76) Inventor: Harrison Fuller, 42 Sugar Maple Dr., Roslyn, NY (US) 11576

( * ) Notice: Subject to any disclaimer, the term of this patent is extended or adjusted under 35 U.S.C. 154(b) by 0 days.

(21) Appl. No.: 09/902,724

(22) Filed: Jul. 12, 2001

(51) Int. Cl.[7] ..... B65B 13/02; B65B 43/26; B65D 85/18

(52) U.S. Cl. ..... 53/399; 53/492; 206/461; 206/278; 206/806

(58) Field of Search ..... 53/397, 399, 413, 53/492, 134.1, 580; 206/461, 278, 806

(56) References Cited

U.S. PATENT DOCUMENTS 2,995,845 A * 8/1961 Fraser ..... 206/278
3,275,274 A * 9/1966 Hutcheon ..... 206/481
4,485,917 A * 12/1984 Smith ..... 206/216
4,863,084 A * 9/1989 Nabozny ..... 2/161.6
5,193,676 A * 3/1993 Gold ..... 206/292
5,522,499 A * 6/1996 DeBiasio et al. ..... 206/278
5,553,706 A * 9/1996 Gold ..... 206/296

* cited by examiner

*Primary Examiner*—M. D. Patterson
(74) *Attorney, Agent, or Firm*—Myron Amer P.C.

(57) ABSTRACT

An assemblage of disposable plastic gloves held firmly in a point-of-sales display to prevent pilferage therefrom and which, during removal from the point-of-sales display after purchase, is slipped off of a cut end of a cardboard length portion contained along with the gloves, such that the grip on the gloves is loosened to the extent that they can be removed one-at-a-time as needed, and the point-of-sales display then serves as a convenient storage organizer for the gloves.

1 Claim, 1 Drawing Sheet

PLASTIC GLOVES ASSEMBLAGE FOR POINT-OF-SALES DISPLAY AND STORAGE

The present invention relates generally to improvements in a point-of-sales display for one-use disposable products, in which for convenience in accessibility to have when needed the products are sold in a number more than several, but typically there is an appreciable time interval between uses, and more particularly to improvements which facilitate the use of the point-of-sales display after its purchase to contribute to convenient storage of the products during those intervals between uses. In the particular case described and illustrated, the product category is disposable plastic gloves sold in an assemblage of six used for painting chores.

EXAMPLE OF THE PRIOR ART

By analogy, reference is made to U.S. Pat. No. 4,766,683 for Mail Bag Tag issued to Fast on Aug. 30, 1988 in which a post office mail bag during handling, analogous to being displayed for sale, is tagged to provide notice of its content, analogous to commercial advertising of the point-of-sale display, and untagged for processing, analogous to the prior art practice of merely removing the purchased products and discarding the sales aid, i.e., the point-of-sales display.

Broadly, it is an object of the present invention to provide a products combination point-of-sales display and storage organizer overcoming the foregoing and other shortcomings of the prior art.

More particularly, it is an object to assemble the products, in this case an assemblage of disposable plastic gloves for painting chores, in a point-of-sales display with sufficient firmness to obviate the pilferage removal or inadvertent disengagement during handling prior to sale, and use the referenced firmness to a sufficient extent after purchase to retain the gloves in their assemblage condition from which they are removed one-at-a-time, contributing to convenient storage of the product, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
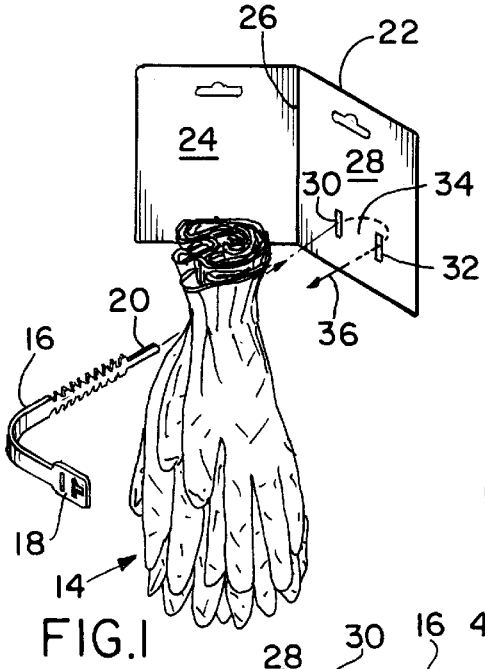
FIG. 1 is a perspective view of the disassembled components of a plastic gloves assemblage point-of-sales display and storage article of manufacture according to the present invention.
Figure 2:
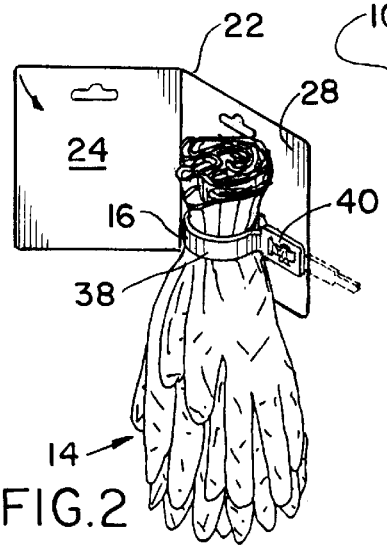
FIG. 2 is similarly a perspective view, but of the components in partial assembly.
Figure 3:
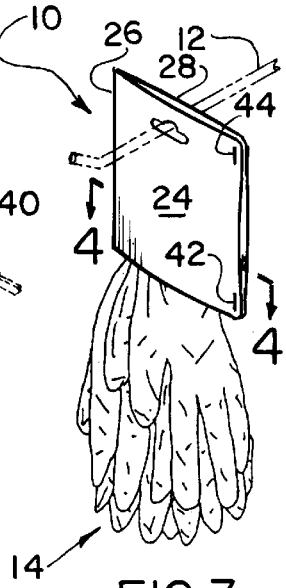
FIG. 3 is a perspective view illustrating a completed assembly of the article in a point-of-sales use.

A point-of-sales display, generally designated 10 in FIG. 3, the hook support 12 of which extending from a peg-board (not shown) or the like sales stand being illustrated in phantom, consists of three components, namely, an assemblage of plastic one-use disposable gloves, individually and collectively designated 14, of the type used for painting chores, the number in this assemblage being 6, a plastic tie 16 with interengaging opposite ends 18 and 20, and a cardboard so-called header, generally designated 22, with a front panel 24 foldable along a fold line 26 against a rear panel 28, the rear panel 28 having a spaced apart pair of notches 30 and 32 bounding therebetween, as at 34, a site or location for the gloves assemblage 14. More particularly, in assembling the display 10 out of the three components, 14, 16 and 22, and as best understood by the sequence of FIGS. 1 and 2, the gloves 14 are positioned against the site 34, the plastic tie 16 threaded through the notches 30, 32, as indicated by the double-arrow reference line 36, and also formed into a closed loop, as at 38, in engagement about the gloves 14, the tie ends 18 and 20 then connected to each other, as at 40, and the unneeded length portion of end 20 removed.

Figure 4:
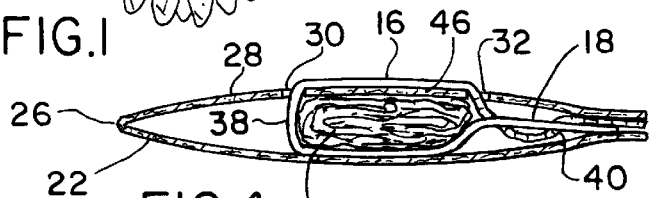
FIG. 4 is a cross sectional view as seen along line 4—4 of FIG. 3.

Front panel 24 is then closed upon the partial assembly of FIG. 2, and the two panels 24 and 28 stapled together, as at 42 and 44. It will be understood that the containment of the gloves 14 within the closed loop 38 of the plastic tie 16 includes the cardboard 46 extending between the notches 30 and 32, as best illustrated in the cross-sectional view of FIG. 4, and that the firmness of this containment or engagement about the gloves obviates pilferage as might result from pulling a single glove from the point-of-sales display of FIG. 3, or inadvertent disassembly of a glove during handling of the display 10.

Figure 5:
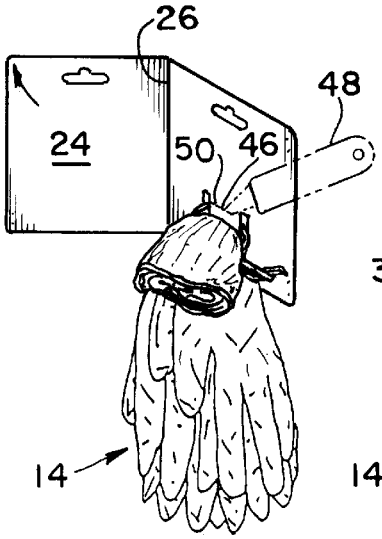
FIG. 5 is a perspective view illustrating partial disassembly of the article.
Figure 6:
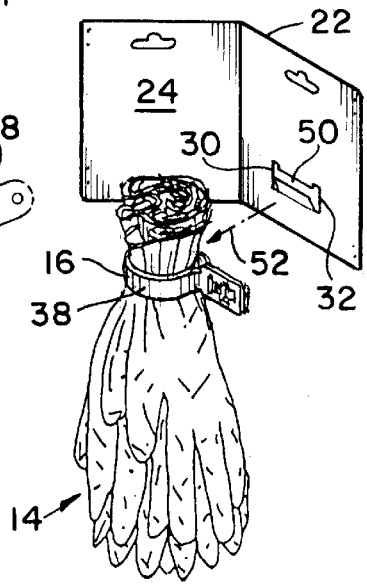
FIG. 6 is similarly a perspective view, but illustrating a complete disassembly, except for the assemblage of the plastic gloves.
Figure 7:
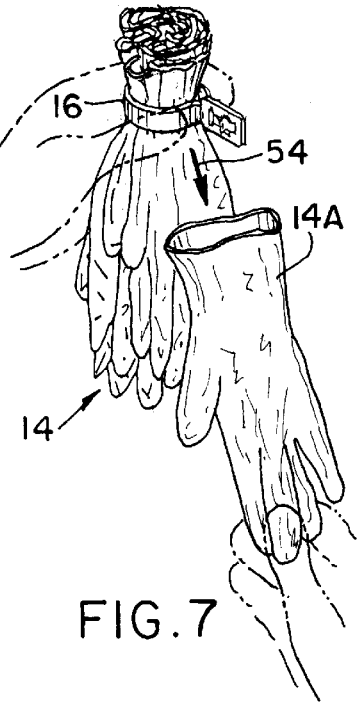
FIG. 7 illustrates in a perspective view the removal of a plastic glove from an assemblage of the gloves in a gloves-storage use.

Reference should now be made to FIGS. 5, 6 and 7, illustrating the handling of the display 10 after its purchase. The staples 42 and 44 are removed, and front panel 24 opened, the top of the gloves 14 folded down to expose the upper ends of the notches 30 and 32 and also to avoid contact with a knife 48 then used to impart a cut 50 in the loop-enclosed previously notched cardboard 46, which then facilitates removal, as noted by the arrow 52 off of the lower edge of the cut 50. When the glove assemblage 14 within the closed loop 38 is slipped off along the cut 50 this, of course, removes the bulk of the cardboard 46 from within the closed loop 38, and the removal of this bulk has been found in practice to contribute to a degree of looseness in the closed loop which facilitates the removal 54 of a plastic glove 14A one-at-a-time as needed, and as illustrated in FIG. 7, and the remaining gloves 14 being maintained as an assemblage for convenience during storage in a tool box, next to paint supplies or under other storage conditions, by the plastic tie 16.

While the point of sales display as well as its method of assembly herein shown and disclosed in detail and use subsequent to purchase is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For a point-of-sales display of cardboard construction material for disposable plastic gloves, a method of attaching an assemblage of said gloves to said display comprising the steps of:

A. providing a pair of notches in spaced apart relation in a panel of said display establishing a glove-positioning site bounded between said notches;

B. positioning an assemblage in a selected number of said gloves adjacent said glove-positioning site;

C. threading a plastic tie with interconnecting opposite ends through said notches and forming a closed loop thereof in encircling gripping engagement about said assemblage of gloves incident to connecting together said plastic tie opposite ends; and D. subsequent to a purchase traversely cutting said positioning site from one notch to the other so as to enable the release of said gloves still in the confines of said plastic tie off of a cut end of said positioning site;

whereby a removal of the cardboard bulk of said positioning-site from said closed loop contributes to a degree of looseness therein which facilitates the removal of a plastic glove one-at-a-time as needed from said gloves maintained as an assemblage for convenience during storage by said plastic tie.

* * * * *